United States Patent [19]

Felski

[11] Patent Number: 4,769,749

[45] Date of Patent: Sep. 6, 1988

[54] MOUNTING DEVICE FOR A DECORATIVE STRING OR CHRISTMAS TREE LIGHT ASSEMBLY

[76] Inventor: William Felski, 1948 Maple Rd., Buffalo, N.Y. 14221

[21] Appl. No.: 49,539

[22] Filed: May 14, 1987

[51] Int. Cl.[4] ..... F21V 21/34

[52] U.S. Cl. ..... 362/250; 362/249; 362/252; 362/806; 211/26; 211/89; 248/316.7; 248/316.1

[58] Field of Search ..... 362/249, 250, 252, 806, 362/807, 808; 211/26, 89; 248/316.7, 316.1

[56] References Cited

U.S. PATENT DOCUMENTS

| | | | |
|---|---|---|---|
| 1,652,825 | 12/1927 | Hechinger | 211/26 |
| 1,690,397 | 11/1928 | Boehland | 362/807 |
| 1,869,321 | 7/1932 | Block | 362/807 |
| 2,595,929 | 5/1952 | Dartt | 362/252 |
| 2,722,317 | 11/1955 | Goodwin | 362/807 |
| 4,339,787 | 7/1982 | Burnbaum | 362/252 |
| 4,357,653 | 11/1982 | Kovacs | 362/252 |
| 4,523,260 | 6/1985 | Duncan | 362/807 |

*Primary Examiner*—Albert W. Davis, Jr.
*Attorney, Agent, or Firm*—Christel, Bean & Linihan

[57] ABSTRACT

A mounting device for releasably supporting a decorative string or Christmas tree light assembly includes at least one elongated, platen-like strip for releasably supporting the light assembly. Each platen-like strip has two opposite faces and two side edges extending between the two faces, and the faces define a plurality of cutouts extending along and opening out of a side edge of the strip. Each cutout is adapted to snuggly accept a socket body of the light assembly inserted endwise into the cutout from a face side thereof, and each strip is constructed of a resiliently bendable material permitting the strip to be manually conformed to any of a number of shapes.

15 Claims, 1 Drawing Sheet

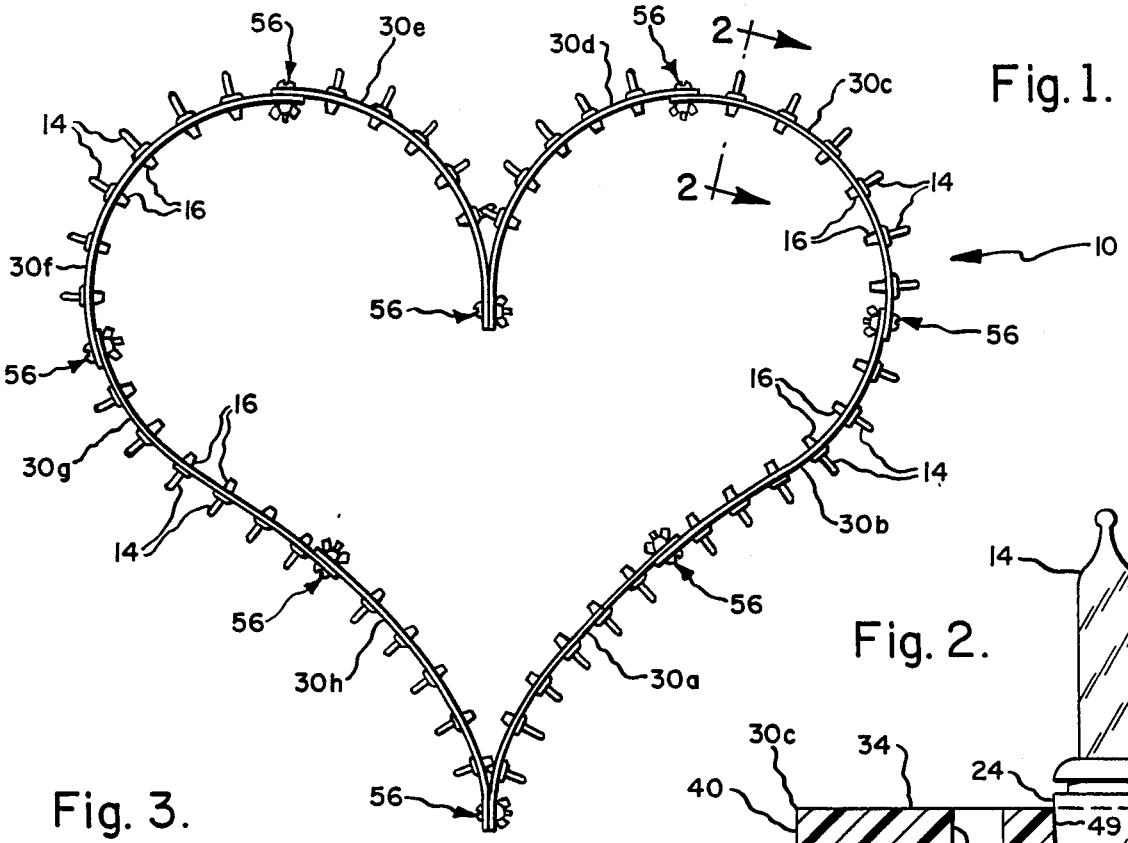
Fig. 1.
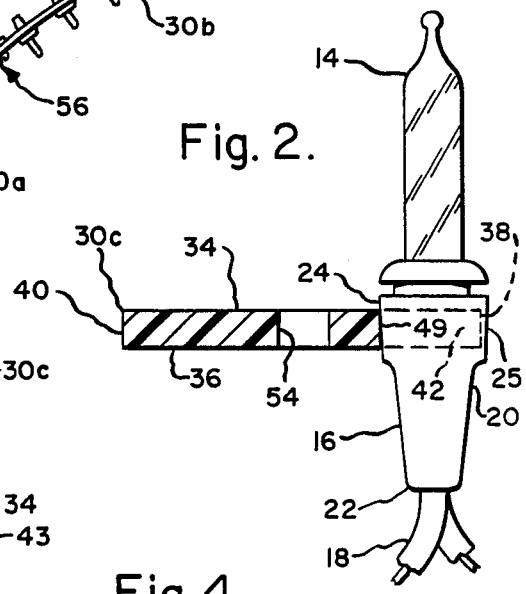
Fig. 2.
Fig. 3.
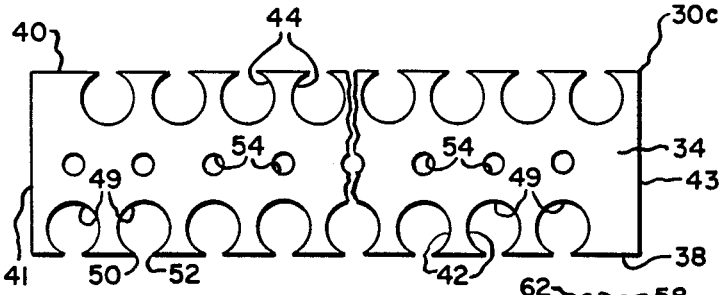
Fig. 4.
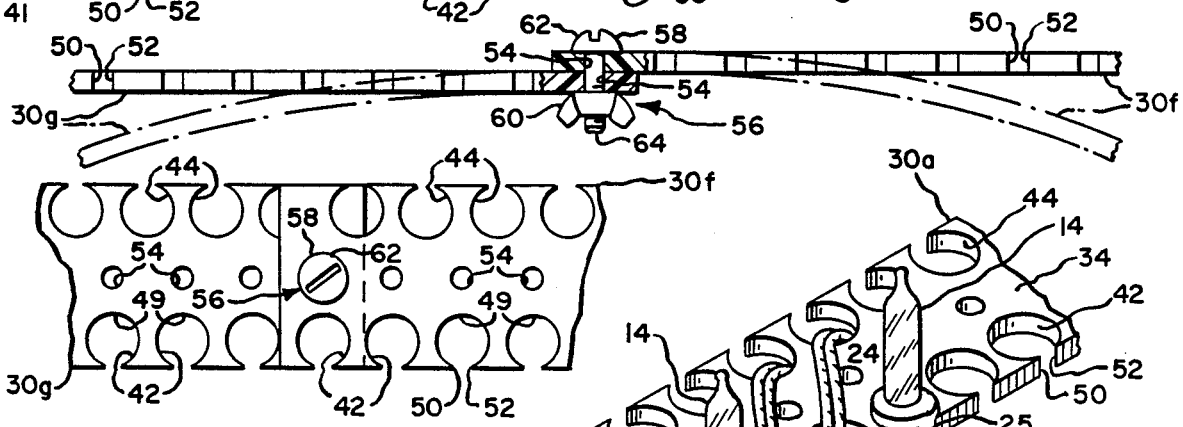
Fig. 5.
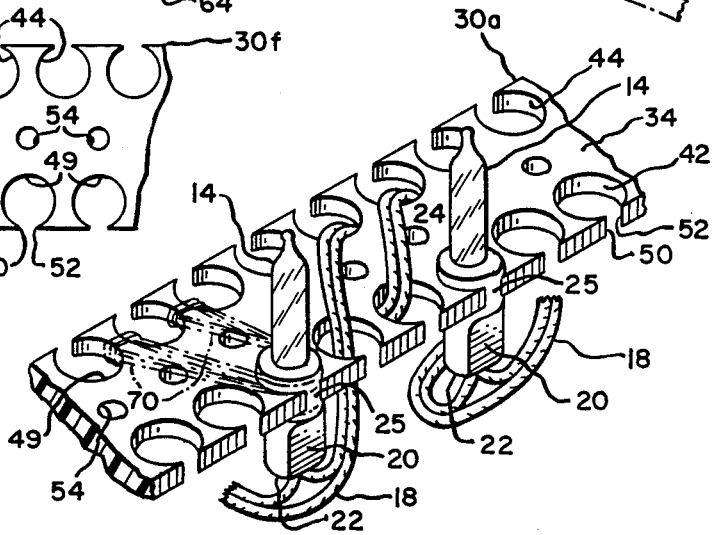
Fig. 6.

MOUNTING DEVICE FOR A DECORATIVE STRING OR CHRISTMAS TREE LIGHT ASSEMBLY

BACKGROUND OF THE INVENTION

This invention relates generally to ornamental display devices and relates more particularly to a mounting device for supporting a decorative string or Christmas tree light assembly.

The type of Christmas tree light assembly with which this invention is concerned includes a plurality of light bulbs, a plurality of bulb sockets and a conducting cord operatively joining the bulb sockets. Each socket includes a socket body having two opposite ends and which includes a tapered portion between its ends so that one body end is narrower than the other body end. Commonly, the other end of the socket body is adapted to receive and thereby operatively support a corresponding light bulb.

It is an object of the present invention to provide a new and improved mounting device for a decorative string or Christmas tree light assembly of the aforedescribed type.

Another object of the present invention is to provide such a device which can be manually bent into a variety of shapes for displaying the supported lights in any of a variety of patterns.

Still another object of the present invention is to provide such a device which can be utilized with devices of like construction for the purpose of providing a mounting device of a preselected shape or length.

Yet still another object of the present invention is to provide such a device which is economical to construct and effective and durable in operation.

SUMMARY OF THE INVENTION

This invention resides in a mounting device for releasably supporting a decorative string or Christmas tree light assembly of the type including a plurality of bulbs, a plurality of bulb sockets and a conducting cord wherein each bulb socket includes an elongated body tapered having tapered portion between its ends so that one body end is narrower than the other body end.

The mounting device includes at least one elongated, platen-like strip having two opposite faces and two side edges extending between the two faces. The faces define a plurality of cutouts extending along and opening out of a side edge thereof, and each cutout is adapted to snugly accept a socket body inserted one-body-end-first into the cutout from a face side thereof. Furthermore, the strip is constructed of a resiliently bendable material permitting the strip to be manually conformed to any of a number of shapes for displaying the supported bulbs in any of a number of patterns.

BRIEF DESCRIPTION OF THE DRAWING FIGURES

FIG. 1 is a front elevation view of an embodiment of the present invention upon which a decorative string or Christmas tree light assembly is operatively mounted.

FIG. 2 is a cross-sectional view taken about on lines 2—2 of FIG. 1.

FIG. 3 is a fragmentary elevation view of a face of a strip of the FIG. 1 mount shown before the light assembly is attached thereto.

FIG. 4 is a fragmentary elevation view of two mounting strips of the FIG. 1 mount shown before the light assembly is mounted thereupon and as seen from a side edge thereof.

FIG. 5 is a fragmentary plan view of the FIG. 1 mount as seen from above in FIG. 4.

FIG. 6 is a fragmentary perspective view of the FIG. 1 mount illustrating a section of the Christmas tree light assembly mounted thereupon.

DETAILED DESCRIPTION OF THE ILLUSTRATED EMBODIMENTS

Turning now to the drawings in greater detail and considering first FIG. 1 there is shown an embodiment of a mounting device, generally indicated 10, in accordance with the present invention and upon which a decorative string or Christmas tree light assembly 12 is operatively mounted. As shown in FIG. 1, the mounting device 10 supports the assembly 12 in a heart-shaped arrangement so that the bulbs of the assembly 12 are arranged in a heart-shaped pattern.

With reference to FIGS. 1 and 2, the Christmas tree light assembly 12 includes a plurality of light bulbs 14,14, a plurality of light sockets 16,16 and a conducting cord 18. Each light socket 16 includes a socket body 20 having two opposite ends 22,24 and which includes a tapered portion 25 between the ends 22,24 so that end 22 is narrower than end 24. Each socket body end 24 is adapted to operatively and supportedly accept the conducting end of a bulb 14, and the conducting cord 18 is operatively joined to the socket 16 through the body end 22 in a manner well known in the art for supplying electrical power to the bulb 14 supported therein. The conducting cord 18 terminates at one end at a terminal plug 24 for conducting power from a conventional electrical outlet (not shown) to the bulbs 14,14.

With reference to FIGS. 1-3, the mount 10 is comprised of eight elongated joined mounting strips **30*a*-30*h*, each having two opposite faces 34,36, two opposite side edges 38,40, and two opposite end portions 41,43. When each strip, such as strip 30*c*, is viewed in the undeformed condition of FIG. 3, the faces 34 and 36 are planar and parallel to one another and the side edges 38 and 40 are planar and parallel to one another. Furthermore, the side edges 38 and 40 are arranged at a a right angle to the faces 34,36** so as to provide the strip with a rectangular cross section.

In accordance with the present invention, each mounting strip is constructed of a resiliently flexible material permitting the strip to be manually bent from the flat, undeformed condition of FIG. 3 to any of the arcuate conditions illustrated by the mounting strips shown in FIG. 1. To this end, the strip material may be comprised of a suitable resilient plastic such as that available under the trade designations Tuffex or Lexan, each available from Great Lakes Plastic Co. Inc., Buffalo, N.Y. and the thickness of each strip as measured between the faces 34,36 is relatively small in comparison to the width of the strip as measured between its side edges 38,40. Because the strip thickness is relatively small in comparison to the strip width, the strip can be bent from the undeformed strip condition as shown in solid lines in FIG. 4 to the deformed condition as shown in phantom in FIG. 4. In the illustrated FIG. 4 and FIG. 1 deformed conditions, the faces 38,40 of each strip is arcuate in shape while the side edges 34,36 of each strip remain generally planar.

In accordance with the present invention and with reference again to FIGS. 2 and 3, each side face 34 or 36 includes a first series of cutouts 42,42 extending along and opening out of the side edge 38 and includes a second series of cutouts 44,44 extending along and opening out of the side edge 40. Each cutout 42 or 44 has been formed by a drilling process so that the longitudinal axis of the cutout 42 or 44 is generally parallel to the plane of the side edges 38 and 40. Furthermore, and as best seen in FIG. 3, cutout 42 or 44 defines an opening at the face 34 or 36 which resembles the major part of a circle (i.e., a circle with a segment missing) having a center which is spaced from the corresponding side edge 38 or 40 a distance which is slightly smaller than the radius of the circle. Furthermore, each cutout 42 or 44 defines an inner wall 49 extending between the faces 34,36 which resembles the greater part of a cylinder and which terminates at opposing linear and parallel edges 50,52. The edges 50,52 are spaced apart a distance at least as great as the thickness of the conducting cord 18 for a reason hereinafter apparent.

Each cutout 42 or 44 is adapted to snuggly receive a socket body 22 inserted endwise therein. More specifically, the radius of the inner wall 49 of each cutout 42 or 44 is slightly smaller than the mean radius of the socket body tapered portion 25 so that when the socket body end 22 is inserted into a cutout 42 or 44 through the cutout opening defined in a face 34 or 36, the tapered portion 25 is snuggly accepted and thereby releasably held by the strip.

Still further and as best shown in FIGS. 3, 4 or 5, the cutouts 42,42 are spaced at regular intervals along the length of the strip side edge 40 and the cutouts 44,44 are regularly spaced along the length of the side edge 40. In the strip embodiments illustrated, the cutouts 42 and 44 is arranged opposite one another in a staggered relationship as best shown in FIGS. 3 and 5.

With reference again to FIG. 3, each strip defines a row of circular apertures or openings 54,54 extending along the length of the strip. The row of openings 54,54 are positioned substantially midway between the side edges 38 and 40 and are spaced at regular intervals along the length of the strip 30. Furthermore, each opening 54 corresponds with or is positioned laterally to one side of a cutout 42 defined along the side edge 38. As will be explained in greater detail hereinafter, the openings 54,54 facilitate the attachment of the strips to one another.

For purposes of illustration, exemplary dimensions of each strip of the FIG. 1 mount 10 are provided here as follows: the thickness of the strip as measured between the faces 34,36 is about 0.125 inches (0.32 cm), the width of the strip as measured between the side edges 38,40 is about 1.2 inches (3.0 cm), the radius of each cutout 42 or 44 is about 0.16 inches (0.40 cm), the centers of adjacent cutouts 42,42 or 44,44 along each side edge 38 or 40, respectively, is about 0.31 inches (0.79 cm) apart, the distance between the opposing and parallel cutout edges 50,52 is about 0.16 inches (0.40 cm), and the length as measured between strip ends 41 and 43 is about 9.75 inches (24.8 cm) long. A strip having such dimensions has been found to be well-suited for holding a Christmas light assembly wherein each socket body 20 has a tapered portion 25 having a mean diameter of about 0.17 inches (0.43 cm) and a cord thickness of about 0.03 inches (0.08 cm).

With reference again to FIG. 1, the mount 10 includes wing nut arrangements 56,56 for operatively attaching the strips **30*a*–32*h* together. As best shown in FIG. 4, each wing nut arrangement 56 includes a screw 58 and a wing nut 60. The screw 58 has a head 62 and a shank 64 upon which the wing nut 60 is threadably received. In the assembled relation and as exemplified by the overlapped relation of strips 30*f* and 30*g* of FIG. 4, one opening 54 of one strip 30*g* is aligned with an opening of the other strip 30*f* and the shank 64 of the screws 58 extends through the aligned openings 54,54. The wing nut 60 is tightened upon the shank 64 so that the strips 30*f* and 30*g* are releasably secured together between the head 62 of the screw 58 and the wing nut 60**.

In the illustrated mount embodiment 10, the opening 54 adjacent an end of each strip is used to join the strip to its adjacent strip and the side edge 38 or 40 of each adjacent strip is generally aligned with the side edge 38 or 40 of the adjacent strip so that joined and adjacent strips form an elongated strip assembly having a length which is equal to about the combined length of the joined and adjacent strips minus the length of overlap between the strips. It will be understood, however, that the length of joined and adjacent strips can be altered by simply removing the wing nut arrangement 56 from one set of aligned openings 54,54, positioning the strips so that an alternative set of openings 54,54 are positioned in alignment with one another, and resecuring the wing nut arrangement 56 through the alternatively-aligned openings.

Because the cutouts 42,44 of the strips are arranged regularly along the length of the side edges 38,40 and the openings 54,54 are arranged regularly along the length of the strips as shown in FIG. 3, the alignment of an opening 54 in one strip with an opening 54 of another strip 54 as shown in FIG. 5 positions a cutout 42 of one strip in alignment with a cutout 42 of another strip. The advantage provided by the consequently-aligned cutouts relates to the fact that even the overlapped cutouts 42,42 at the strip ends can be used to operatively hold a bulb socket 20 when the socket body is operatively inserted into the aligned cutouts.

As mentioned earlier, the cutout edges 50,52 defined in the side edges 38,40 are sufficiently spaced to permit the conducting cord 18 of the light assembly 12 to pass edgewise therethrough. Such spacing facilitates the operative insertion of a bulb socket 20 within a cutout 42 or 44 in that prior to inserting a bulb socket 20 within a cutout 42 or 44, the portion of the conducting cord 18 attached to the socket body end 22 is passed through the spacing as aforesaid so as to be positioned within the cutout 42 or 44. At that point, the socket 20 is inserted cord-end, or body-end-22-first, into the cutout 42 or with no interference from the cord 18. Furthermore, the acceptance of the cord 18 by each cutout 42 or 44 permits the cord 18 to be neatly wrapped about the strip when the light assembly 12 is mounted thereupon. For example, and with reference to FIG. 6 in which the cord 18 is illustrated in a wrapped condition about a strip **30*a*, the section, indicated 62, of the cord 18 extending between two adjacent bulb sockets 20,20 positioned within the cutouts 42,44 so that the cord section 62 does not loosely drape from the strip 30*a***.

Another advantage of the mounting strip relates to its plastic construction. More specifically, because the plastic is not conductive to electricity, the handling of the strip while the electric light assembly 12 is mounted thereupon is rendered relatively safe.

Still another advantage of the mounting strip relates to its adaptability to hold, in conjunction with an elastic or rubber band, bulb sockets within the strip cutouts if the bulb sockets are slightly undersized for or are loosely received by the cutouts. For example, there is shown in FIG. 6 a rubber band 70, illustrated in phantom, operatively wrapped about the bulb socket 20 and strip 30*a* for securably retaining the socket 20 within the cutout and preventing relative movement between the socket 20 and strip. Therefore, even if the cutouts were slightly oversized for the bulb sockets expected to be positioned therein, rubber bands can be effectively utilized to stably secure the bulb sockets within the strip. Rubber bands can also be wrapped about the strip and conducting cord 18 to maintain the cord 18 against the faces of the strip and thereby enhance the neatness in appearance of the mount and light assembly held thereby.

It will be understood that numerous modifications and substitutions can be had to the aforedescribed embodiments without departing from the spirit of the invention. For example, although the mount 10 has been shown and described as including eight strips 30*a*–30*h*, strips 30*a*–30*d* could be replaced by a single strip while the strips 30*e*–30*h* could be replaced by a single strip. Accordingly, the aforedescribed embodiment is intended for purpose of illustration and not as limitation.

I claim:

1. In a mounting device for supporting a decorative string or Christmas tree light assembly of the type including a plurality of bulbs, a plurality of bulb sockets and a conducting cord, each bulb socket including an elongated body having a tapered portion between its ends so that one body end is narrower than the other body end, the improvement characterized in that:

the mounting device includes at least one elongated platen-like strip having two opposite faces and two side edges extending between said two faces, said two faces defining a first plurality of cutouts extending along and opening out of one side edge of said strip and a second plurality of cutouts extending along and opening out of the other side edge of said strip, each cutout having an inner wall which extends between said opposite faces and adapted to snuggly accept the tapered portion of a bulb socket inserted said-one-body-end-first into the cutout from a face side thereof so that when the tapered portion of the bulb socket is operatively inserted into a cutout as aforesaid to a snug condition therein, the inner wall of the cutout pressingly engages opposite sides of the tapered portion to thereby securely retain the bulb socket in the cutout and so that when a mounting strip carrying the bulb socket is arranged so that said one body end of the tapered portion of the bulb socket is directed generally upwardly, the bulb socket is prevented from falling out of the cutout, the opening of each cutout at the corresponding side edge of said strip is of such size to permit the passage of a conducting cord therethrough so that by passing the conducting cord therethrough and into the cutout prior to the operative endwise insertion of a bulb socket through the cutout, the bulb socket can be inserted into the cutout with no interference from the conducting cord and so that by utilizing less than all of the cutouts for holding sockets of the light assembly and wrapping the cord about the strip, the cord can be accepted by the openings of the remaining cutouts; and said strip is constructed entirely of a resiliently bendable plastic which is not conductive to electricity and which permits said strip to be manually conformed to any of a number of shapes and to thereby facilitate the arrangement of light bulbs supportable therein in any of a number of patterns for display.

2. The improvement of claim 1 wherein said strip is of such a shape that when in an undeformed condition, said opposite faces are generally planar and parallel to one another and said two side edges are generally planar and parallel to one another and oriented generally perpendicular to said opposite faces and the thickness of said strip as measured between said opposite faces is substantially smaller than the width of said strip as measured between said side edges so that said strip is relatively easy to bend between its undeformed condition to a condition at which each of said opposite faces assumes an arcuate shape.

3. The improvement of claim 1 wherein said cutouts of at least one of said first and second plurality of cutouts are regularly spaced along the length of the corresponding side edge of said strip.

4. The improvement of claim 1 wherein each of said cutouts has an opening disposed across each face having a shape which resembles the major part of a circle.

5. The improvement of claim 4 wherein the radius of one opening in one face of said cutout is substantially the same as the radius of the facial opening of every other cutout in said one face.

6. The improvement of claim 1 wherein said inner wall of each cutout has a shape resembling the greater part of a cylinder.

7. The improvement of claim 1 wherein each cutout of said first and second plurality of cutouts are regularly spaced along the length of the corresponding side edge.

8. The improvement of claim 1 wherein said mounting device includes at least two elongated, platen-like strips and a shanked fastener, each of said strips defining at least one aperture extending between its side faces and which is aligned with the aperture of the other strip and said strips are fastened together by said fastener as the shank of said fastener extends through said aligned apertures.

9. The improvement of claim 8 wherein said mounting device includes a screw and wing nut arrangement wherein said shanked fastener is provided by said screw and the wing nut is tightened upon the shank of said screw so that the strips are releasably held together between the head of the screw and the wing nut.

10. A mounting device for supporting decorative string or Christmas tree light assembly of the type including a plurality of bulbs, a plurality of bulb sockets and a conducting cord joining the bulb sockets wherein each bulb socket includes an elongated body having a tapered portion between its ends so that one body end is narrower than the other body end, said mounting device comprising:

two elongated platen-like strips each having opposite faces and two side edges extending between the two faces, the two faces of each strip defining a first plurality of cutouts extending along and opening out of one side edge of the corresponding strip and a second plurality of cutouts extending along and opening out of the other side of the corresponding strip wherein each cutout defines an inner wall which extends between the opposite faces of the corresponding strip and adapted to snuggly accept the tapered portion of the bulb socket inserted said-one-body-end-first end into the cutout from a side face thereof so that when the tapered portion of a bulb socket is operatively inserted into a cutout as aforesaid to a snug condition therein, the inner wall of the cutout pressingly engages opposite sides of the tapered portion to thereby securely retain the bulb socket in the cutout and so that when a mounting strip carrying the bulb socket is arranged so that said one body end of the tapered portion of the bulb socket is directed generally upwardly, the bulb socket is prevented from falling out of the cutout and wherein the cutout opening defined at a corresponding side edge of said strip is of such size to permit the passage of said conducting cord therethrough and into the cutout so that by passing the conducting cord into the cutout prior to the operative endwise insertion of a bulb socket through the cutout, the bulb socket can be inserted into the cutout with no interference from the conducting cord and so that by utilizing less than all of the cutouts for holding sockets of the light assembly and wrapping the cord about the strip, the cord can be accepted by the openings of the remaining cutouts, each of said strips defining an aperture extending between its faces which is with the aperture defined in the other of said strips in any of a number of alternative angular orientations of one strip in relation to the other strip; and a screw and wing nut arrangement releasably securing the two strips together, the shank of said screw extending through the aligned apertures in the two strips and said wing nut being threadably received by the shank of said screw so that said two strips are held together between the head of said screw and the wing nut, each of said strips being constructed of a resiliently bendable material permitting the secured strips to be manually conformed to any of a number of shapes and thereby facilitating the arrangement of light bulbs supportable therein in any of a number of patterns and being constructed of a plastic which cannot conduct electricity thereby enhance the safety of said mounting device.

11. The device of claim 10 wherein at least one of said strips includes a plurality of apertures extending between its ends so that said one strip can be selectively arranged in overlying relationship with the other strip with one or another of its plurality of apertures being aligned with the aperture defined in the other of said strips to facilitate the adjustment of the length of said strips in the secured relation.

12. The device of claim 10 wherein said strip is of such a shape that when in an undeformed condition, said opposite faces are generally planar and parallel to one another and said two side edges are generally planar and parallel to one another and oriented generally perpendicular to said opposite faces and the thickness of said strip as measured between said opposite faces is substantially smaller than the width of said strip as measured between said side edges so that said strip is relatively easy to bend between its undeformed condition to a condition at which each of said opposite faces assumes an arcuate shape.

13. The device of claim 10 wherein each of said cutouts of said first plurality of cutouts are regularly spaced along the length of one side edge of each strip and each of said cutouts of said second plurality of cutouts are regularly spaced along the length of the other side edge of each strip.

14. The device of claim 13 wherein said strips are attachable to one another so that a face of one strip faces a face of the other strip and at least one cutout of one strip is aligned with a cutout of the other strip so that a bulb socket operatively inserted within the aligned cutouts is snuggly held therein.

15. In combination:

a decorative string or Christmas tree light assembly of the type including a plurality of bulbs, a plurality of bulb sockets and a conducting cord joining the bulb sockets, each bulb socket including elongated body having a tapered portion between its ends so that one body end is narrower than the other body end;

a mounting device including at least one elongated, platen-like structure having two opposite faces and two side edges extending between the two faces, the two faces defining a first plurality of cutouts extending along and opening of one side of edge of said strip and a second plurality of cutouts extending along and opening of the other side edge of said strip, each cutout having an inner wall which extends between said opposite faces and adapted to snuggly accept the tapered portion of a bulb socket inserted said-one-body-end-first into the cutout from a face side thereof so that when the tapered portion of a bulb socket is operatively inserted into a cutout as aforesaid to a snug condition therein, the inner wall of the cutout pressingly engages opposite sides of the tapered portion to thereby securely retain the bulb socket in the cutout and so that when a mounting strip carrying the bulb socket is arranged so that said one body end of the tapered portion of the bulb socket is directed generally upwardly, the bulb socket is prevented from falling out of the cutout, the opening of each cutout and at corresponding side edge of said strip is of such size to permit the passage of said conducting cord therethrough so that by passing the conducting cord therethrough and into said cutout prior to the operative endwise insertion of a bulb socket through the cutout, the bulb socket can be inserted into the cutout with no interference from the conducting cord and so that by utilizing less than all of the cutouts for holding bulb sockets from the light assembly and wrapping the cord about a strip, the cord can be accepted by the openings of the remaining cutouts to enhance the neatness with which the cord is wrapped about the strip, said strip being constructed of a resiliently bendable material permitting said strip to be manually conformed to any of a number of shapes and thereby facilitating the arrangement of light bulb supportable therein in any of a number of patterns for display and being constructed of a plastic which cannot conduct electricity to enhance the safety of the mounting device.

* * * * *